US006647651B2

(12) United States Patent
Cutright

(10) Patent No.: US 6,647,651 B2
(45) Date of Patent: Nov. 18, 2003

(54) ANIMATED THEME SHADE

(75) Inventor: David J. Cutright, 1013 Powdermill Rd., Gatlinburg, TN (US) 37738

(73) Assignee: David J. Cutright, Gatlinburg, TN (US)

( * ) Notice: Subject to any disclaimer, the term of this patent is extended or adjusted under 35 U.S.C. 154(b) by 17 days.

(21) Appl. No.: 09/933,286

(22) Filed: Aug. 20, 2001

(65) Prior Publication Data

US 2002/0026733 A1 Mar. 7, 2002

Related U.S. Application Data

(60) Provisional application No. 60/226,294, filed on Aug. 21, 2000.

(51) Int. Cl.[7] ..... G09F 13/00
(52) U.S. Cl. ..... 40/431; 40/554
(58) Field of Search ..... 40/731, 493, 506, 40/473, 486, 431, 554; 362/360, 283; 353/16; 352/2

(56) References Cited

U.S. PATENT DOCUMENTS

| | | | | |
|---|---|---|---|---|
| 1,728,166 A | | 9/1929 | Horton | |
| 1,930,048 A | * | 10/1933 | Harding et al. | 40/554 |
| 2,913,954 A | * | 11/1959 | Morgan | 40/431 |
| 3,304,640 A | | 2/1967 | Swartz | |
| 4,244,126 A | * | 1/1981 | James | 40/431 |
| 4,817,315 A | | 4/1989 | Kammerer et al. | |
| 5,760,874 A | | 6/1998 | Rudnick | |

* cited by examiner

*Primary Examiner*—Cassandra H. Davis
(74) *Attorney, Agent, or Firm*—Pitts & Brittian, PC

(57) ABSTRACT

An animation device is provided in which a series of pictures are arranged on a translucent shell, which is mounted upon an inner frame. A periodic light emitter is mounted on the inner frame. A driver, such as an electric motor, moves the translucent shell relative to the inner frame to sequentially pass the series of pictures over the periodic light emitter, thus creating an animation effect for a viewer. The series of pictures is removable to permit replacement with an alternate series of pictures.

8 Claims, 2 Drawing Sheets

ANIMATED THEME SHADE

CROSS-REFERENCE TO RELATED APPLICATIONS

Provisional Application No. 60/226,294, Aug. 21, 2000

STATEMENT REGARDING FEDERALLY SPONSORED RESEARCH OR DEVELOPMENT

Not applicable

TECHNICAL FIELD

The present invention relates generally to animation display devices and more particularly to devices that rotate around a periodic light source to provide an animation effect.

BACKGROUND OF THE INVENTION

In the field of lampshades it has been known to provide a picture or other design on the inner or outer surface of a translucent lampshade so that light shining from within the lampshade illuminates the design for a viewer. This concept is disclosed in U.S. Pat. No. 4,817,315 issued to Kammerer et al, for example, wherein several separate layers of artwork are provided to develop a three-dimensional design that is lit by the light within the lampshade. It has also been known to provide means for rotating a lampshade that has a picture or other design incorporated into the shade. U.S. Pat. No. 3,304,640 issued to Swartz and U.S. Pat. No. 1,728,166 issued to Horton both disclose mechanisms wherein the heat of a light source is used to create convection currents that rotate a portion of the lampshade. In this manner the design may be seen from all directions around the lamp. However, it is only a single design that is viewable. In addition, the speed of rotation is irregular because it is dependent upon the speed and volume of the convection airflow. U.S. Pat. No. 5,760,874 to Rudnick discloses a method and apparatus for displaying animated designs on a rotating, transparent, cylindrical lampshade that has multiple facets. The viewer must look through both sides of the cylindrical body in order to see the animation effect on the inner surface of the far side of the lampshade. A light mounted within the lampshade would obscure the view of the designs located on the opposite side of the shade. Moreover, there is provision for only one sequence of animation figures in the '874 device.

SUMMARY OF THE INVENTION

In accordance with the present invention an animation device is provided in which a series of pictures are arranged on a translucent shell, which is mounted upon an inner frame. A periodic light emitter is mounted on the inner frame. A driver, such as an electric motor, moves the translucent shell relative to the inner frame to sequentially pass the series of pictures over the periodic light emitter, thus creating an animation effect for a viewer. The series of pictures is removable to permit replacement with an alternate series of pictures.

BRIEF DESCRIPTION OF THE DRAWINGS

The above mentioned features of the invention will become more clearly understood from the following detailed description of the invention read together with the claims and drawings in which:

BEST MODE FOR CARRYING OUT THE INVENTION

Figure 1:
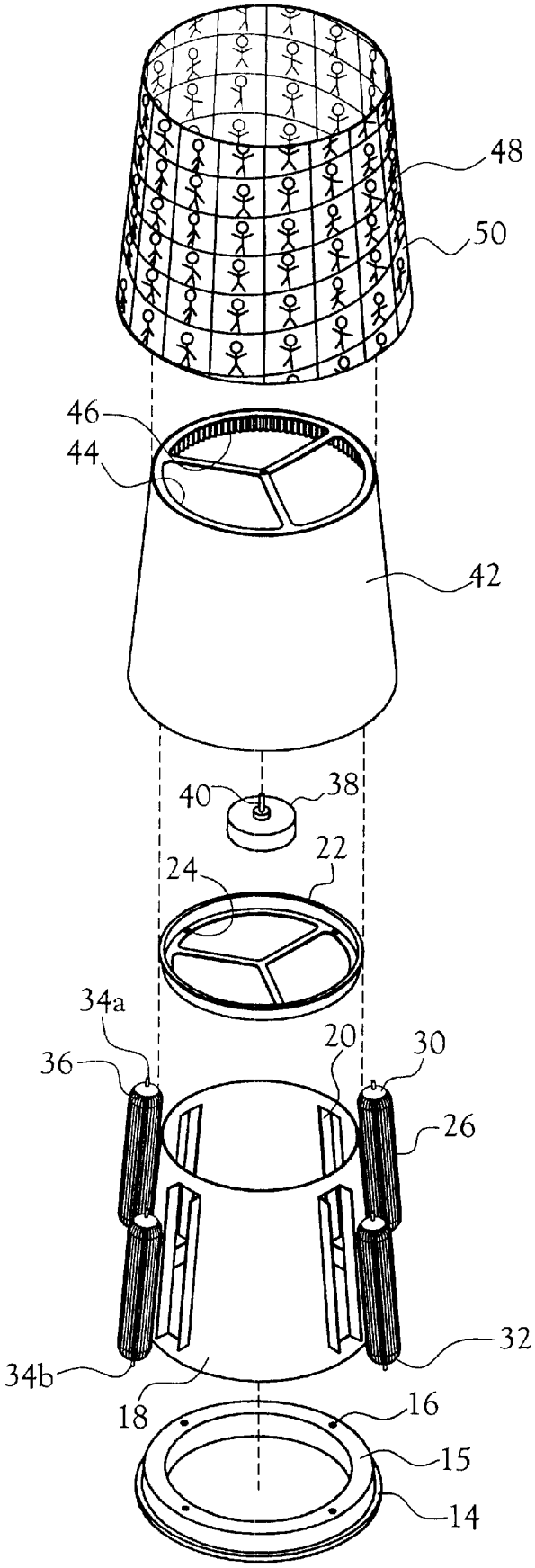
FIG. 1 is an exploded view of an animation device in accordance with the present invention.
Figure 2:
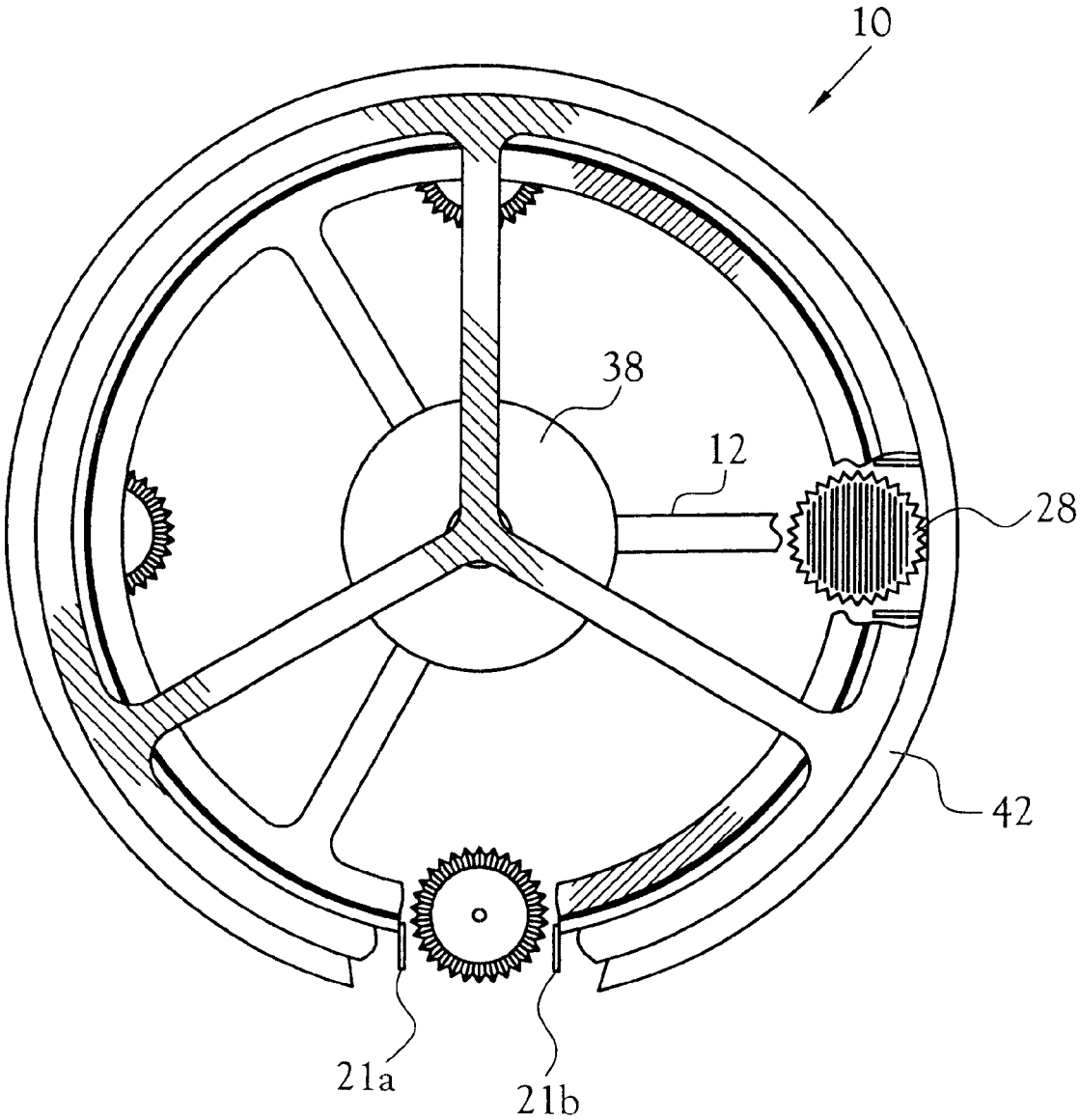
FIG. 2 is an elevation view of an animation device in accordance with the present invention.

Referring now to the FIGS. in which like reference numerals indicate like or corresponding features, there is shown in FIG. 1 an unassembled animation device 10 adapted for attachment to a standard lamp having a central light bulb 11 and a harp for attachment. An inner frame 12 comprises a circular base 14 having a planar top surface 15. Four bottom apertures 16 are defined in the top surface 15, spaced every 90°. A frustum-shaped shield 18, formed from a non-translucent material, such as metal or a plastic is seated upon and secured to the base 14. Four longitudinal slots 20 are defined in the shield 18, spaced every 90°. Each slot 20 is bordered by two longitudinal flaps 21*a* and 21*b*, which extend outwardly from the shield 18. A circular cap 22 defining four top apertures 24, spaced every 90°, is seated within the shield 18.

Four shutters 26 are mounted within the slots 20. The four shutters 26 are substantially similar, so that only one shutter 26 will be described in detail. Each shutter 26 comprises a plurality of planar vanes 28 of graduating width. The vanes 28 are secured in parallel and spaced relation by a top cap 30 and a bottom cap 32. Each of the top cap 30 and the bottom cap 32 includes an axial rotation pin 34*a* and 34*b*, respectively. Each of the pins 34*a* and 34*b* is sized to rotatably fit within a top aperture 24 and a bottom aperture 16, respectively. The shutter 26 is thus rotatable within the slot 20. The top cap 30 includes a geared peripheral surface 36 adapted to drive the rotation of the shutter 26.

An electric motor 38, which receives electrical power by apparatus well known in the art, is secured to the cap 22. The motor 38 includes a drive shaft 40 that extends upwardly from the cap 22. In the depicted device, the drive shaft 40 rotates at approximately 15 rpm, but it will be recognized that other speeds may be used, particularly depending upon the size of the animation device.

A translucent shell 42 is secured to the drive shaft 40 for rotational movement relative to the frame 12. The depicted shell 42 is a frustum in shape, so that the frame 12 is nested within the shell 42, so that the frame 12 and the shell 42 are generally equidistant over their lengths and peripheries. The top, inner peripheral edge 44 of the shell 42 includes a geared surface 46 adapted to engage the geared peripheral surface 36 of the top caps 30 of the shutters 26. In the depicted embodiment, the number of gear teeth per inch of geared surface provides 180° of rotation of the shutters 26 as the rotation of the shell 42 moves the width of one of the pictures 50.

A removable film wrap 48 is applied to the outer surface of the translucent shell 42. In the depicted embodiment, the wrap 48 is a frustum in shape to fit securely over and cover the shell 42 without substantial gaps. A plurality of pictures 50 is arranged in a coil pattern around the wrap 48. Each picture is slightly different from the adjacent pictures along the coil, so that intermittent viewing of progressive pictures provides an animation effect, i.e. an appearance of movement by the objects in the pictures. The width of each picture is approximately equivalent to the width of the slot 20. Each wrap 48 may be provided with a cue indicator that is aligned with a cue marker on the shell 42 to ensure correct alignment of the pictures 50 with the slots 20 when the shutter 26 is open to emit light through the slot 20.

In operation, a light bulb 11 (not shown) inside the inner frame 12 and the motor 38 are activated electrically. Activation of the motor 38 causes rotation of the drive shaft 40, which in turn effects rotation of the shell 42 relative to the frame 12. As the shell 42 rotates around the fixed inner frame 12, the engagement of the geared surface 46 of the shell 42 with the geared surfaces 36 of the top caps 30 effects rotation of the shutters 26. Rotation of the shutters 26 provides periodic emission of light through the slots 20. The vanes 28 ensure that the periodic emission of light is a sharp pulse of light. The timing of the rotation of each shutter 26 is such that as a picture is located directly over a slot 20, the vanes 28 of the shutter 26 for that slot 20 are oriented generally radially toward the axis of rotation of the shell 42. Each slot 20 is then darkened by rotation of the planar surfaces of the vanes 28 of the shutter 26 to block light from the slot until the next picture is aligned with the slot 20. By that time, the shutter 26 has rotated 180° so that the vanes 28 are again radially aligned to emit light through the slot 20.

When a viewer looks toward a slot 20, starting at the bottom of the shade, his/her eyes naturally follow the rotating coil of the pictures 50. The periodic emission of light through the slot 20 and the pictures 50 provide an animation effect. In one embodiment in which 140 pictures are applied to a shell 42 in a coil pattern and the shell is rotated at a rate of 15 rpm, a twenty-eight second animation is provided.

The removable film wrap 48 permits replacement of the sequence of pictures so that viewers are provided with a variety animation sequences. It will be recognized by those skilled in the art that various light emitters may be used to provide periodic light emissions. For example, a strobe light could be electronically timed to match the times at which pictures are aligned with the light emitter. In addition, the present invention may be used to project animated images on a screen or wall.

While a preferred embodiment has been shown and described, it will be understood that it is not intended to limit the disclosure, but rather is intended to cover all modifications and alternate methods and apparatus within the spirit and scope of the invention as defined in the appended claims.

What is claimed is:

1. An animation display device comprising:

a translucent shell, a series of pictures arranged on said translucent shell, an inner frame located within said translucent shell, a periodic light emitter mounted on said inner frame within said translucent shell, and a driver for moving said translucent shell relative to said inner frame to sequentially pass said series of pictures over said periodic light emitter and create an animation effect for a viewer.

2. An animation display device as defined in claim 1 wherein said series of pictures are arranged in a coil pattern.

3. An animation display device as defined in claim 1 wherein said translucent shell is a frustum in shape.

4. An animation display device as defined in claim 1 wherein said driver comprises an electric motor.

5. An animation display device as defined in claim 1 wherein said periodic light emitter comprises a light source located within said inner frame and a shutter rotatably mounted upon said frame.

6. An animation display device as defined in claim 5 wherein said shutter includes a geared surface, said translucent shell includes a geared surface and said geared surface of said shutter is engaged with said geared surface of said translucent shell, whereby rotation of said translucent shell generates rotation of said shutter.

7. An animation display device as defined in claim 5 wherein said shutter comprises a plurality of parallel vanes defining a cylindrical shape.

8. An animation display device as defined in claim 1 wherein said series of pictures are carried on a removable film wrap applied to said shell.

* * * * *